US008845560B1

(12) United States Patent
Hernandez et al.

(10) Patent No.: US 8,845,560 B1
(45) Date of Patent: Sep. 30, 2014

(54) PHYSICAL THERAPY CHAIR

(76) Inventors: Antonio Hernandez, Laveen, AZ (US); Diego Vazquez, Phoenix, AZ (US); Javier Hernandez, Phoenix, AZ (US); Juan Carlos Valenzuela Gallardo, Phoenix, AZ (US); Marcos Galindo, Phoenix, AZ (US); Michelle Myrann, Phoenix, AZ (US); Joan Davis, Phoenix, AZ (US); Maureen Tiernan, Laveen, AZ (US)

( * ) Notice: Subject to any disclaimer, the term of this patent is extended or adjusted under 35 U.S.C. 154(b) by 730 days.

(21) Appl. No.: 13/163,651

(22) Filed: Jun. 17, 2011

(51) Int. Cl.
*A61H 1/00* (2006.01)

(52) U.S. Cl.
USPC ..... 601/33; 601/15; 601/24; 601/35; 601/46; 482/142; 297/338; 297/344.12; 297/411.29

(58) Field of Classification Search
CPC ..... A61H 1/00; A61H 1/02; A61H 1/0574; A61H 1/0281; A61H 1/0285; A61H 2001/00; A61H 2001/02; A61H 2001/0234; A61H 2001/0211; A61H 2201/1602; A61H 2201/1635; A61H 2201/1638; A61H 2201/1624; A61H 2203/0431; A61H 2205/06; A61H 2205/10; A61H 2205/106; A61G 15/007; A61G 13/009; A63B 21/0455; A63B 23/0233; A63B 21/1492; A63B 21/00065; A63B 21/00069; A61B 2210/02
USPC ..... 601/5, 15, 23, 24, 26, 33, 34, 35, 46, 601/84, 97, 98, 100, 101; 482/51, 52, 56, 482/57, 62, 140, 142; 128/845; 606/237, 606/241–245; 297/115, 116, 118, 311, 338, 297/344.1, 344.12, 411.25, 411.26, 411.29, 297/411.31, 411.32, 411.33, 411.34, 297/411.35, 411.36, 411.37, 411.38, 297/411.39; 5/613, 617, 618
See application file for complete search history.

(56) References Cited

U.S. PATENT DOCUMENTS

| | | | | |
|---|---|---|---|---|
| 3,641,995 | A * | 2/1972 | Brandt | 601/26 |
| 3,712,613 | A | 1/1973 | Feather et al. | |
| 3,774,597 | A | 11/1973 | Root | |
| 4,089,330 | A | 5/1978 | Nicolosi et al. | |

(Continued)

OTHER PUBLICATIONS

William Hermann, ASU Poly Students Developing Robotic Physical Therapy Device, The Arizona Republic, Oct. 15, 2009, available at http://www.azcentral.com/community/gilbert/articles/2009/10/15/20091015mr-polyrobo1016.html (last visited Jun. 3, 2011).

(Continued)

*Primary Examiner* — Quang D Thanh
(74) *Attorney, Agent, or Firm* — Adam R. Stephenson, Ltd.

(57) ABSTRACT

A physical therapy chair. Implementations may include a seat bottom coupled to a chair base adjustable along a z axis. A seat back couples to the seat bottom at an angle to the axis. An arm support slidably couples to the seat back and is fixable at desired positions. An arm has first, second, and third arm portions. The first arm portion pivotally couples to the arm support, the second arm portion rotatably couples to the first arm portion, and the third arm portion rotatably couples to the second arm portion. A leg couples to the seat bottom and has upper and lower leg portions. The upper leg portion has an upper first portion and an upper second portion. The upper first portion pivotally couples to the seat bottom and slidably couples to the upper second portion which slides thereby to change a length of the upper leg portion.

19 Claims, 5 Drawing Sheets

(56) References Cited

U.S. PATENT DOCUMENTS

| | | | | |
|---|---|---|---|---|
| 4,807,601 | A | 2/1989 | Wright | |
| 5,020,795 | A | 6/1991 | Airy et al. | |
| 5,040,522 | A | 8/1991 | Daniels | |
| 5,110,121 | A * | 5/1992 | Foster | 601/24 |
| 5,158,074 | A | 10/1992 | Grellas | |
| 5,161,522 | A | 11/1992 | Clevenger | |
| 5,417,643 | A | 5/1995 | Taylor | |
| 5,487,590 | A * | 1/1996 | Haynes | 601/24 |
| 5,722,937 | A | 3/1998 | Smith | |
| 5,738,636 | A | 4/1998 | Saringer et al. | |
| 6,015,394 | A | 1/2000 | Young | |
| 6,273,865 | B1 | 8/2001 | Perez | |
| 6,676,612 | B1 | 1/2004 | Beny et al. | |
| 6,821,234 | B1 | 11/2004 | Barbee | |
| 6,821,288 | B2 | 11/2004 | Schaeffer | |
| 6,893,386 | B2 | 5/2005 | Charoenchit | |
| 7,402,145 | B1 | 7/2008 | Woggon et al. | |
| 7,452,308 | B2 * | 11/2008 | Robideau | 482/51 |
| 7,544,173 | B2 | 6/2009 | Suzuki | |
| 2004/0127821 | A1 | 7/2004 | Ou et al. | |
| 2010/0313897 | A1 | 12/2010 | Schaeffer | |

OTHER PUBLICATIONS

MassagerMachines&More, Buyer's Guide for Massage Chairs, available at http://www.massager-machines-and-more.com/how-to-choose-massage-chair.asp (last visited Jun. 6, 2011).

* cited by examiner

PHYSICAL THERAPY CHAIR

BACKGROUND

1. Technical Field

Aspects of this document relate generally to physical therapy chairs.

2. Background Art

Physical therapy chairs exist for a variety of purposes. Massage chairs, for instance, may be used by those with no major ailments but may provide some muscular benefit or relaxation thereby. Other chairs may be used more specifically to stimulate and/or move patient limbs in order to benefit the muscular or other health of a patient with physical ailments.

SUMMARY

Implementations of physical therapy chairs may include: a seat bottom coupled to a chair base, the seat bottom configured to be positionally adjustable along a z axis; a seat back coupled to the seat bottom at an angle with respect to the z axis; an arm support slidably coupled to the seat back and pivotally coupled with one or more arms at an end of the arm support, each of the one or more arms having first, second, and third arm portions, the arm support configured to slide along the seat back and to be fixed at a desired position along the seat back; and one or more legs pivotally coupled to the seat bottom, each of the one or more legs having an upper leg portion and a lower leg portion, the upper leg portion including an upper first portion and an upper second portion, the upper first portion pivotally coupled to the seat bottom and slidably coupled to the upper second portion, the upper second portion configured to slide relative to the upper first portion thereby changing a length of the upper leg portion; and wherein a first end of the first arm portion is pivotally coupled to the arm support at an end of the arm support, a first end of the second arm portion is rotatably coupled to a second end of the first arm portion, and a first end of the third arm portion is rotatably coupled to a second end of the second arm portion.

Implementations of physical therapy chairs may include one, all, or any of the following:

The second arm portion and third arm portion may be configured to rotate in a plane substantially parallel with a length of the first arm portion and the z axis.

The lower leg portion may be rotatably coupled to an end of the upper second portion of the upper leg portion and configured to rotate about the end in a plane substantially parallel with a length of the upper leg portion and the z axis.

The one or more arms may be configured to pivot in a plane perpendicular to the angle of the seat back.

The first arm portion may be configured to pivot about the end of the arm support in a plane substantially parallel with a length of the arm support and substantially perpendicular to the angle of the seat back relative to the z axis.

The third arm portion may be rotatable between an angle of about 0 to about 180 degrees with respect to the second arm portion.

A stop may be rotatably coupled to and extending from the seat back and configured to prevent the seat bottom from descending below a predetermined height.

The seat bottom may be rotatable about the z axis.

The second arm portion, third arm portion, upper leg portion and lower leg portion may each have a V-shaped cross section configured to receive a limb of a patient.

A vibrating element may be coupled to the seat bottom configured to vibrate the chair and one or more heating elements located in padding coupled to one of the seat bottom, seat back, second arm portion, third arm portion, upper leg portion, and lower leg portion.

The chair base may be coupled to one or more rolling members configured to allow the chair to be rolled with respect to a ground surface.

A V-shaped headrest may be telescopically coupled at an end of the seat back opposing the seat bottom, the V-shaped headrest configured to receive the head of a patient.

Implementations of physical therapy chairs may include: a height adjustable seat bottom coupled to one or more rolling members configured to allow the chair to be rolled with respect to a ground surface; a seat back coupled to the seat bottom; an arm support coupled to the seat back; a first arm portion pivotally coupled to the arm support and pivotable in a first plane substantially parallel with a length of the arm support and perpendicular to an angle of the seat back relative to the seat bottom; a V-shaped second arm portion rotatably coupled to the first arm portion and rotatable in a second plane substantially perpendicular to the first plane; a V-shaped third arm portion rotatably coupled to the second arm portion and rotatable in the second plane; a V-shaped upper leg portion pivotally coupled to the seat bottom and rotatable in a third plane substantially parallel with the seat bottom, a V-shaped lower leg portion rotatably coupled to the upper leg portion and rotatable in a fourth plane substantially perpendicular with the third plane; one or more heating elements located in padding coupled to one of the seat bottom, seat back, second arm portion, third arm portion, upper leg portion, and lower leg portion; and a vibrating element coupled to the seat bottom configured to vibrate the chair.

Implementations of physical therapy chairs may include one, all, or any of the following:

The upper leg portion may include an upper first portion and an upper second portion wherein the upper first portion is pivotally coupled to the seat bottom and is slidably coupled to the upper second portion and the upper second portion is configured to slide relative to the upper first portion thereby changing a length of the upper leg portion.

The arm support may be slidably coupled to the seat back and is configured to slide along the seat back.

The seat bottom may be height adjustable along a first axis perpendicular to the ground surface and the seat bottom is rotatable about the first axis.

A stop may extend from the seat back and may be configured to prevent the seat bottom from descending below a predetermined height.

The third arm portion may be rotatable between an angle of about 0 to about 180 degrees with respect to the second arm portion.

A V-shaped headrest may be telescopically coupled at an end of the chair back opposing the seat bottom, the V-shaped headrest configured to receive the head of a patient.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended physical therapy chair and/or assembly procedures for a physical therapy chair will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such physical therapy chairs and implementing components, consistent with the intended operation.

Figure 1:
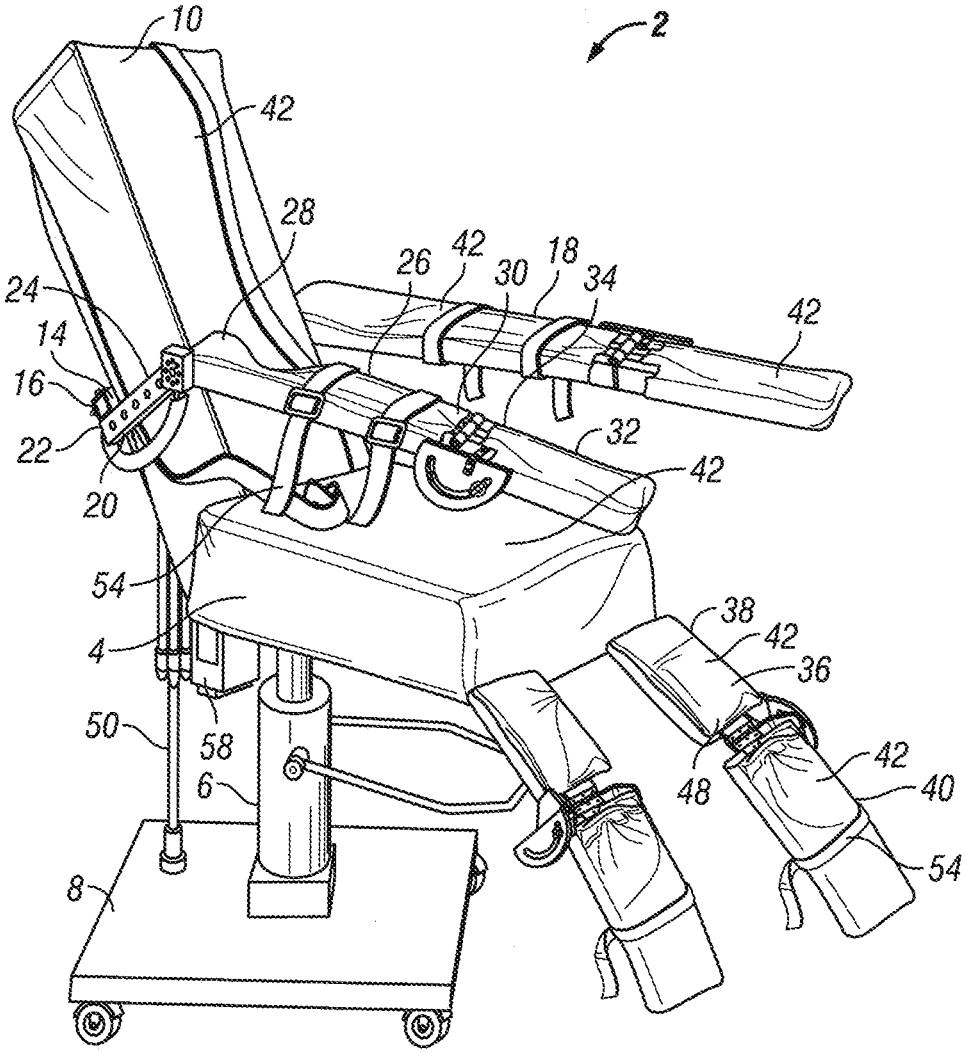
FIG. 1 is a perspective view of an implementation of a physical therapy chair.

Referring now to FIG. 1, an implementation of a physical therapy chair 2 includes a seat bottom 4 coupled to a chair base 6. The chair base 6 in this implementation may be similar to the type commonly used in connection with a chairs used by barbers and includes a foot pedal which may be activated to adjust the seat bottom 4 along a z axis (first axis) roughly collinear with the longest length of the chair base 6 and roughly perpendicular to the largest planar face of the seat bottom 4. Other implementations could use other devices for moving the seat bottom 4 along the z axis such as, by non-limiting example, a lever, a screw which causes the seat bottom 4 to raise and lower upon spinning the seat bottom 4, an electrical automated mechanism, and any other system capable of lifting and holding the chair in a desired position. In the implementations shown in the drawings the z axis (first axis) is substantially perpendicular to a ground surface though in other implementations the z axis could form a non-zero angle with a line that is substantially perpendicular to a ground surface. In various implementations the seat bottom 4 may be rotatable about the first axis.

A stop 50 extends from the seat back 10 and is configured to prevent the seat bottom 4 from descending below a predetermined height. The stop 50 has an adjustable longest length and is rotatably coupled to one of the seat back 10 and the arm support 14, and is thereby rotatable over a plane substantially parallel with the longest length of the seat back 10 such that it may be rotated into and out of a position in which it prevents the seat bottom 4 from descending below a predetermined height. Some implementations of the physical therapy chair 2 may exclude the stop 50 and may rely on the chair base 6 itself to prevent the seat bottom 4 from descending below a predetermined height or hard stop.

The chair base 6 is coupled to a rolling member 8 which may include several rollers to allows the physical therapy chair 2 to roll with respect to a ground surface. The rolling member 8 may be configured to have a stopping or braking feature to render it unrollable when desired. In some implementations the physical therapy chair 2 may not have a rolling member 8.

Figure 2:
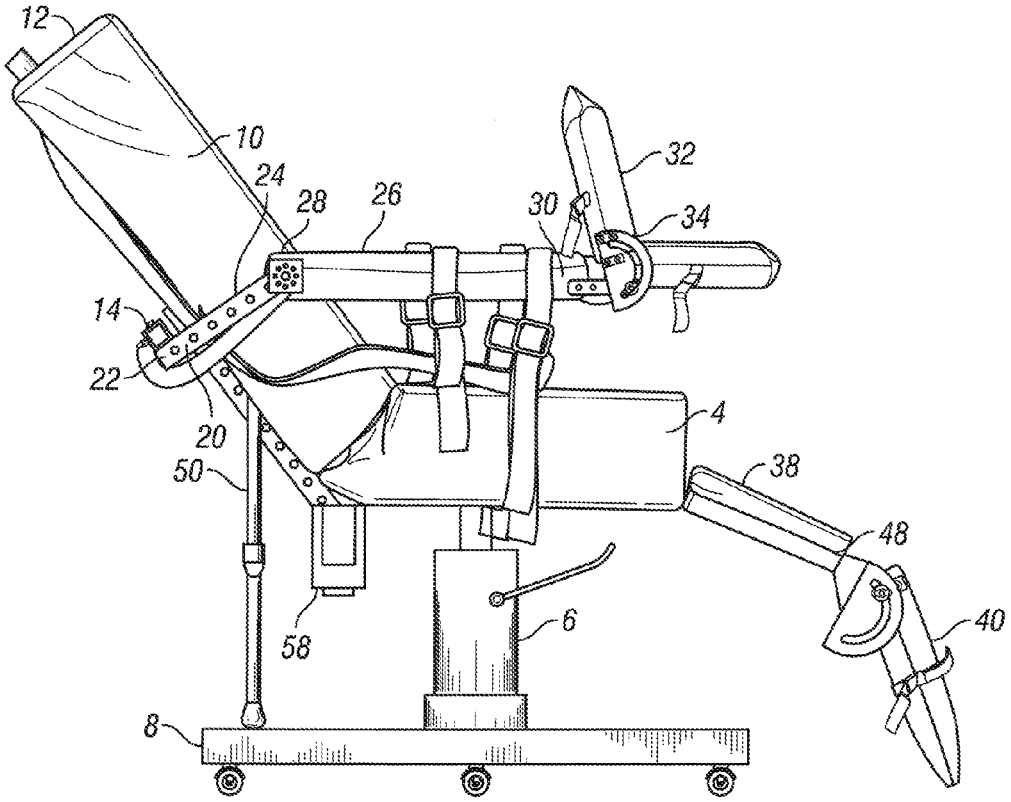
FIG. 2 is a side view of an implementation of a physical therapy chair.

Coupled to the seat bottom 4 is a seat back 10 which forms an angle with respect to the z axis. In some implementations the seat back 10 forms an angle with the z axis which is non-adjustable and in other implementations the angle and seat back 10 are adjustable. At an end 12 of the seat back 10 opposing the seat bottom 4 is a coupler to which a headrest may be coupled. The headrest is not shown, but the coupler may be seen at the top of the seat back 10 in FIG. 2 and FIG. 5 as a cylindrical hollow tube extending out of the top of the seat back 10. Into this tube may be placed a cylindrical rod of a headrest so that it may telescopically slide to various heights to accommodate the head of a patient. In various implementations the headrest has a V-shape formed by padding configured to receive the head of the patient.

Figure 5:
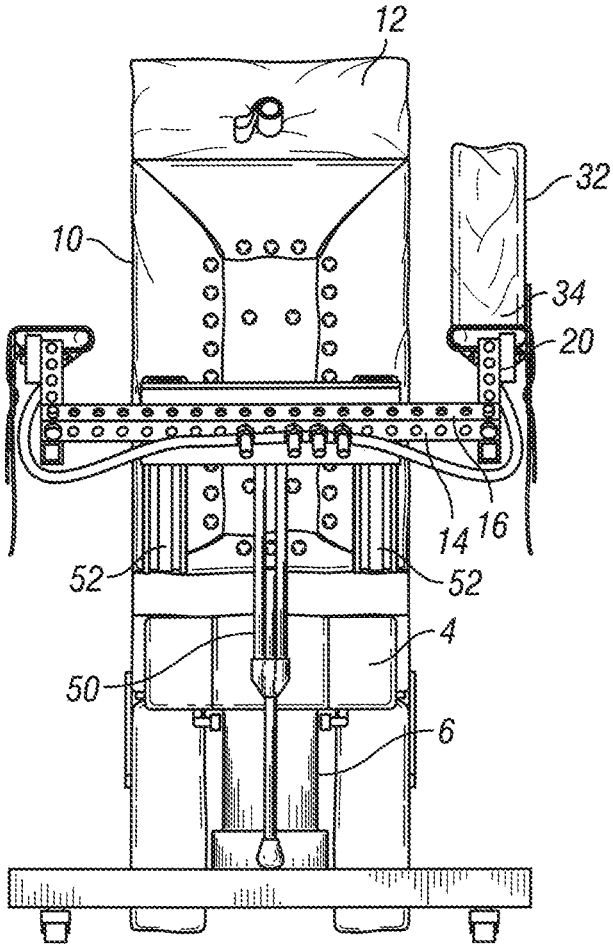
FIG. 5 is a rear view of an implementation of a physical therapy chair.

At the back of the seat back 10, most clearly visible in FIG. 5, is an arm support 14. The arm support 14 is coupled to the seat back 10 via tracks 52 and is slidable thereby to various heights up and down the back of the seat back 10. The arm support 14 may be fixed at a desired position along the seat back 10. Referring back to FIG. 1, an arm 18 is coupled to the arm support 14. While in FIG. 1, two arms 18 are illustrated, in particular implementations, only one arm 18 may be used. The arm 18 includes a first arm portion 20, a second arm portion 26, and a third arm portion 32. A first end 22 of the first arm portion 20 is pivotally coupled to an end 16 of the arm support 14. A first end 28 of the second arm portion 26 is rotatably coupled to a second end 24 of the first arm portion 20. A first end 34 of the third arm portion 32 is rotatably coupled to a second end 30 of the second arm portion 26.

The pivotable and rotatable nature of various portions of the arm 18, due to the structures of the hinges and couplers used to couple the various portions, allows the arm 18 to be adjustable to various positions. The ability of the arms 18 to articulate in two locations is useful for instance, by non-limiting example, to receive and stretch the muscles of the limbs of patients which are contorted into various positions by virtue of muscle inflexibility, or to hold the limbs of patients in safe positions during treatment or for other purposes—such as for physically fragile children. The adjustability of the arm 18 to various positions allows the arm 18 to be secured to the limb of a patient regardless of the configuration or rigid shape of the patient's arm. Some patients, for instance, may have limbs that are not easily conformable to normal positions. Instead of the limb being conformed to the chair, then, the arm 18 of the physical therapy chair 2 disclosed herein may be conformed to support the limb.

The various portions of the arm 18 are configured to rotate and pivot in and about various planes due to the configurations of the structure of the couplers coupling the various portions and, additionally, the entire arm 18 is adjustable up and down along a line substantially parallel with the longest length of the seat back 10 by virtue of the arm 18 being coupled to the slidable arm support 14. By virtue of the coupling of the first arm portion 20 to the arm support 14 the first arm portion 20 is configured to pivot in a plane (first plane) substantially perpendicular to the angle that the seat back 10 makes with respect to the z axis (or in other words, pivot substantially perpendicular to the plane formed by the angle of the seat back 10 relative to the z axis). The first arm portion 20 also pivots in a plane substantially perpendicular to the longest length of the seat back 10, in a plane substantially perpendicular to an angle of the seat back 10 relative to the seat bottom 4 (or in other words substantially perpendicular to the plane formed by the angle of the seat back 10 relative to the seat bottom 4), and in a plane substantially parallel with a length of the arm support 14. In the implementations shown in the drawings the first arm portion 20 is also pivotable in a plane substantially parallel with the longest length of the arm support 14

The second arm portion 26 and third arm portion 32 are configured to rotate in a plane (second plane) substantially parallel with a length of the first arm portion 20 and the z axis. The second arm portion 26 and third arm portion 32 are also rotatable in a second plane that is substantially perpendicular to the first plane in which the first arm portion 20 pivots. The third arm portion 32 is rotatable between an angle of about 0 degrees to about 180 degrees with respect to the second arm portion 26. In FIG. 1 the third arm portion 32 is seen forming an angle of about 180 degrees with respect to the second arm portion 26, and in FIG. 2 the third arm portion 32 is seen forming an angle of about 85 degrees with respect to the second arm portion 26. The third arm portion 32 rotates in the same plane as the second arm portion, or in the second plane.

Figure 6:
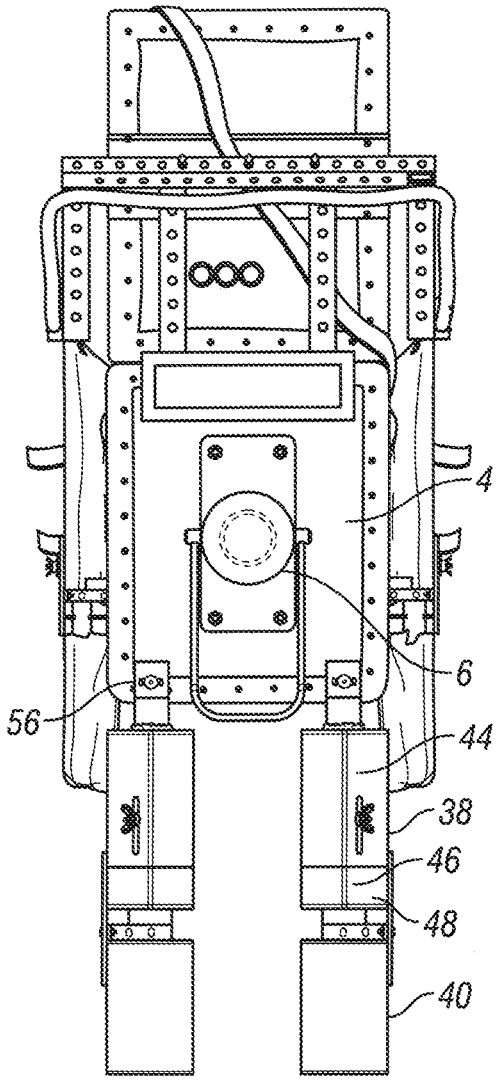
FIG. 6 is a bottom view of an implementation of a physical therapy chair.

Referring to FIG. 1, coupled to the seat bottom 4 is a leg 36. The leg 36 has an upper leg portion 38 and a lower leg portion 40. Referring now to FIG. 6, which is a bottom view of the physical therapy chair 2, the upper leg portion 38 is coupled to the seat bottom 4 with a pivotal coupling 56. The upper leg portion 38 is thereby rendered rotatable in a plane (third plane) substantially parallel with the seat bottom 4. In the implementations shown in the drawings the upper leg portion 38 is also rotatable in a plane that is substantially parallel with a largest-area face of the seat bottom 4. A largest-area face on the underside of seat bottom 4 is seen head-on in FIG. 6 and the other largest-area face of the seat bottom 4 is opposite on the top of the seat bottom 4, and is visible in FIG. 1. The lower leg portion 40 rotatably couples to the upper leg portion 38 and is rotatable in a plane (fourth plane) which is substantially perpendicular with the plane in which the upper leg portion 38 is rotatable.

Referring now to FIG. 6, the upper leg portion 38 has an upper first portion 44 which is pivotally coupled to the seat bottom 4 and is slidably coupled to an upper second portion 46. The upper first portion 44 and upper second portion 46 are configured to slide relative to one another thereby changing a length of the upper leg portion 38, such as for instance to locate the coupler that connects the upper leg portion 38 to the lower leg portion 40 at a location corresponding with the knee joint of the patient. In the implementations illustrated, the upper first portion 44 and upper second portion 46 are configured to slide relative to one another to increase or decrease the longest length of the upper leg portion 38. The lower leg portion 40 is rotatably coupled to an end 48 of the upper second portion 46 of the upper leg portion 38 and is configured to rotate about the end 48 in a plane which is substantially parallel with a length of the upper leg portion 38 and the z axis, or in a plane which is substantially parallel with the longest length of the upper leg portion 38 and the z axis. In the implementations in the drawings the slidablity of the upper first portion 44 and upper second portion 46 is accomplished by providing a slot in the upper first portion 44 and a screw or bolt which extends from the upper second portion 46 through the slot, and a wingnut coupled to the bolt which may tighten it to prevent sliding. Thus when the wingnut is loosened the upper first portion 44 and upper second portion 46 may be slid relative to one another via the bolt and slot and when the wingnut is tightened the upper first portion 44 and upper second portion 46 are fixed into place relative to one another.

Figure 3:
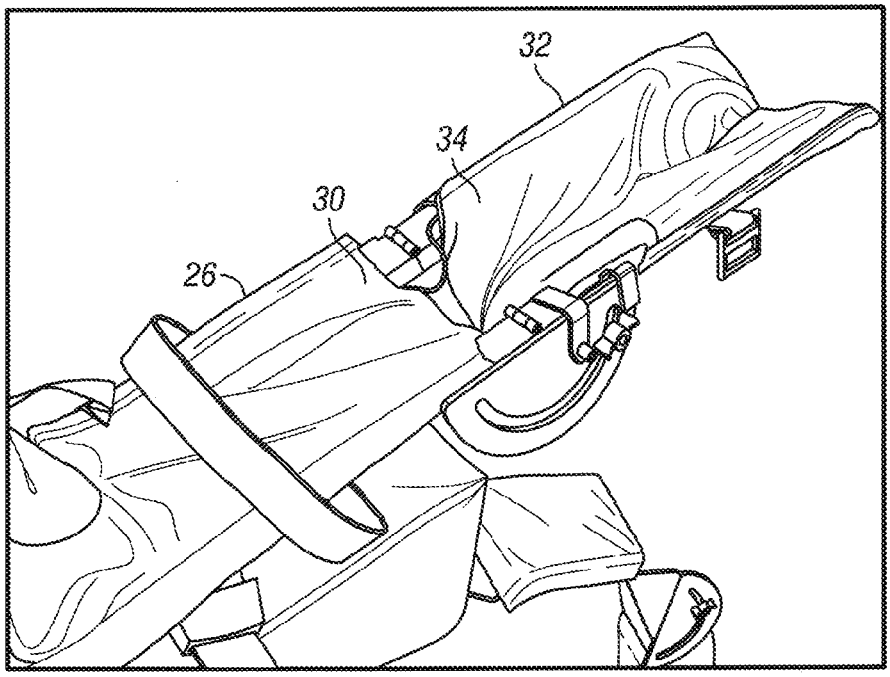
FIG. 3 is a close-up perspective view of an arm of an implementation of a physical therapy chair.
Figure 4:
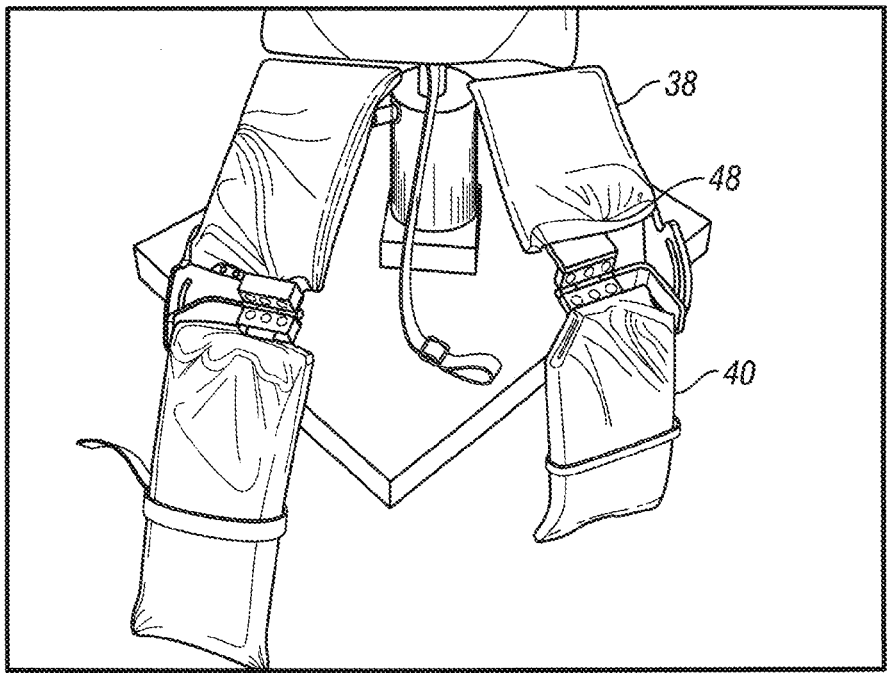
FIG. 4 is a close-up front view of legs of an implementation of a physical therapy chair.

Referring now to FIG. 3, in implementations the second arm portion 26 has a V-shaped cross section along its longest length configured to receive an upper arm of a patient (i.e., approximately the segment from the shoulder to the elbow). In various implementations the third arm portion 32 also has a V-shaped cross section along its longest length configured to receive a lower arm (forearm) of a patient. Referring now to FIG. 4, in implementations the upper leg portion 38 has a V-shaped cross section along its longest length configured to receive the upper leg of a patient (approximately the femoral portion). In implementations the lower leg portion 40 has a V-shaped cross section along its longest length configured to receive the lower leg of a patient (the portion below the knee). In particular implementations, the various portions may contain padding which flexes upon receiving the limb of a patient to form the V-shaped cross section.

In FIG. 1 tie-downs 54 are seen in various locations attached to the leg 36 and the arm 18. These may be used to secure the head, torso, limbs, hands, and/or feet of a patient to the physical therapy chair 2.

Various portions of the physical therapy chair 2, including the seat bottom 4, seat back 10, second arm portion 26, third arm portion 32 upper leg portion 38, lower leg portion 40, and headrest may each include padding 42. The padding 42 may include foam. This may provide comfort to the patient and may help to prevent injury to the patient during use. Heating elements may be coupled to one or more of any of these portions, or integrated within them and/or integrated within the padding 42 in order to provide therapeutic heat to the various areas of the body of the patient including the head, back, and limbs. The heating elements may be any of a wide variety of types, including, by non-limiting example, silicone encapsulated electrical heating wires, padding that is designed to be heated in water or a microwave and placed in position, or any other structure or device capable of being externally or internally heated. A vibrating element may be included in one or more of the above portions including the seat bottom 4, seat back 10, second arm portion 26, third arm portion 32, upper leg portion 38, lower leg portion 40 and/or headrest. In the implementations illustrated, a rotating vibrating mechanism is coupled to the bottom of the seat bottom 4 in the box next to the controller 58 and is used to vibrate the entire physical therapy chair 2. In this implementation, the rotating vibrating mechanism includes a triangular element fastened at one vertex to a rotating shaft driven by a bathroom ventilation fan motor to form an eccentric vibrating element that vibrates the entire chair.

In various implementations, and as illustrated in FIG. 1, a controller 58 may be utilized to control the vibrating and/or the temperature of heating elements. The controller 58 may automatically control the vibration and/or heating through various control systems and logic, including, by non-limiting example, proportional integral derivative (PID) controllers, feedback loop controllers, over temperature and overcurrent fuses, power distribution systems, and any other structure, system, or algorithm for controlling electrical heat and/or power distribution. In various implementations, computer controlled systems that have preset programs or utilize programmable logic controllers that incorporate, by non-limiting example, Application Specific Integrated Circuits (ASICs), Field-Programmable Gate Arrays (FPGAs), or other microprocessors and microcontrollers may be incorporated into the controller 58. In particular implementations the vibrating mechanism may be situated within a box associated with, adjacent to, or separate from the controller 58.

Various types of couplers may be used to fasten the various portions together and to render them rotatable or pivotable, including hinges, bolts, screws, wingnuts, and the like. Locking mechanisms may be used to selectively disallow the various portions from rotating or pivoting. For instance where the first arm portion 20 is coupled to the arm support 14 a bolt is used. As this bolt is loosened, the first arm portion 20 may pivot, but as the bolt is tightened the first arm portion 20 is prevented from pivoting.

The mechanism that allows the second arm portion 26 to rotate and selectively disallows it from rotating includes a block with a plurality of holes drilled therethrough that surround a central hole in the block. The second arm portion 26 is coupled to the block and the end of the first arm portion contains a pin that rotates in the central hole. A bolt is passed through one of the plurality of holes in the block through the block and through a hole in the end of the first arm portion. A cotter or other pin may be passed through the end of the bolt to secure it into position. With the bolt in place, the combination of the block and the hole in the end of the first arm portion prevent further rotation of the second arm portion 26.

Where the third arm portion 32 couples to the second arm portion 26, a hinge is used which allows rotation. A screw/bolt and wingnut in a slot may be tightened to disallow the rotation once the third arm portion 32 is at a desired position, and may be loosened to allow rotation again. In addition, the screw/bolt prevents further motion as it encounters the end of a circular arc in a plate in which the screw/bolt ride while the third arm portion 32 rotates relative to the second arm portion 26. The pivotal coupling 56 uses a bolt and a wingnut—when the wingnut is loosened the upper leg portion 38 may pivot and when tightened it is prevented from pivoting. Where the lower leg portion 40 couples to the upper leg portion 38 there is a coupling mechanism similar to that used at the juncture of the third arm portion 32 with the second arm portion 26 that allows and disallows rotation as desired—except that with the arm 18 the hinge allows the third arm portion 32 to rotate upwardly or away from the ground surface in conjunction with the movement of a patient's upper arm and with the leg 36 the hinge allows the lower leg portion 40 to rotate downwardly or toward the ground surface in conjunction with a patient's lower leg. Any of these couplers types could be interchanged and many other hinges and coupler types could also be utilized in various implementations.

To use the physical therapy chair 2, a caregiver sets the various portions of the arm 18 and leg 36 to desired positions, as well as the height of the seat bottom 4, thereby adjusting the physical therapy chair 2 to fit a patient's dimensions and/or limb configurations, and locks the arms and/or legs into place before a patient sits in the physical therapy chair 2. Alternatively, some or all of the adjusting and locking could be done after the patient sits down. The caregiver may also secure the limbs of the user to the chair using the tie-downs 54 if desired. The caregiver may then active the vibration and or the heat during therapy manner as desired, either manually through the controller 58 or by starting a preset program through the controller 58 that the caregiver or another has programmed into the controller 58. Portions of the arms and legs of the chair may not be fixed, or may be released and rotated as desired during therapy to promote increased muscular flexibility for a child or patient dealing with muscle rigidity symptoms. When therapy is completed, the caregiver may remove the tie-downs 54 and assist the patient out of the chair, unlocking and adjusting the various portions of the arm 18 and leg 36 and the height of the seat bottom 4 as necessary.

The invention claimed is:

1. A physical therapy chair comprising:

a seat bottom coupled to a chair base, the seat bottom configured to be positionally adjustable along a z axis;

a seat back coupled to the seat bottom at an angle with respect to the z axis;

an arm support slidably coupled to the seat back and pivotally coupled with one or more arms at an end of the arm support, each of the one or more arms comprising first, second, and third arm portions, the arm support configured to slide along the seat back and to be fixed at a desired position along the seat back; and one or more legs pivotally coupled to the seat bottom, each of the one or more legs comprising an upper leg portion and a lower leg portion, the upper leg portion comprising an upper first portion and an upper second portion, the upper first portion pivotally coupled to the seat bottom and slidably coupled to the upper second portion, the upper second portion configured to slide relative to the upper first portion thereby changing a length of the upper leg portion; and wherein a first end of the first arm portion is pivotally coupled to the arm support at an end of the arm support, a first end of the second arm portion is rotatably coupled to a second end of the first arm portion, and a first end of the third arm portion is rotatably coupled to a second end of the second arm portion.

2. The chair of claim 1 wherein the second arm portion and third arm portion are configured to rotate in a plane substantially parallel with a length of the first arm portion and the z axis.

3. The chair of claim 1 wherein the lower leg portion is rotatably coupled to an end of the upper second portion of the upper leg portion and configured to rotate about the end in a plane substantially parallel with a length of the upper leg portion and the z axis.

4. The chair of claim 1 wherein the one or more arms is configured to pivot in a plane perpendicular to the angle of the seat back.

5. The chair of claim 1 wherein the first arm portion is configured to pivot about the end of the arm support in a plane substantially parallel with a length of the arm support and substantially perpendicular to the angle of the seat back relative to the z axis.

6. The chair of claim 1, wherein the third arm portion is rotatable between an angle of about 0 to about 180 degrees with respect to the second arm portion.

7. The chair of claim 1, further comprising a stop rotatably coupled to and extending from the seat back and configured to prevent the seat bottom from descending below a predetermined height.

8. The device of claim 1, wherein the seat bottom is rotatable about the z axis.

9. The device of claim 1, wherein the second arm portion, third arm portion, upper leg portion and lower leg portion each comprise a V-shaped cross section configured to receive a limb of a patient.

10. The chair of claim 1, further comprising a vibrating element coupled to the seat bottom configured to vibrate the chair and one or more heating elements comprised in padding coupled to one of the seat bottom, seat back, second arm portion, third arm portion, upper leg portion, and lower leg portion.

11. The chair of claim 1, wherein the chair base is coupled to one or more rolling members configured to allow the chair to be rolled with respect to a ground surface.

12. The chair of claim 1, further comprising a V-shaped headrest telescopically coupled at an end of the seat back opposing the seat bottom, the V-shaped headrest configured to receive the head of a patient.

13. A physical therapy chair, comprising:

a height adjustable seat bottom coupled to one or more rolling members configured to allow the chair to be rolled with respect to a ground surface;

a seat back coupled to the seat bottom;

an arm support coupled to the seat back;

a first arm portion pivotally coupled to the arm support and pivotable in a first plane substantially parallel with a length of the arm support and perpendicular to an angle of the seat back relative to the seat bottom;

a V-shaped second arm portion rotatably coupled to the first arm portion and rotatable in a second plane substantially perpendicular to the first plane;

a V-shaped third arm portion rotatably coupled to the second arm portion and rotatable in the second plane;

a V-shaped upper leg portion pivotally coupled to the seat bottom and rotatable in a third plane substantially parallel with the seat bottom, a V-shaped lower leg portion rotatably coupled to the upper leg portion and rotatable in a fourth plane substantially perpendicular with the third plane;

one or more heating elements comprised in padding coupled to one of the seat bottom, seat back, second arm portion, third arm portion, upper leg portion, and lower leg portion; and a vibrating element coupled to the seat bottom configured to vibrate the chair.

14. The chair of claim 13, wherein the upper leg portion comprises an upper first portion and an upper second portion wherein the upper first portion is pivotally coupled to the seat bottom and is slidably coupled to the upper second portion and the upper second portion is configured to slide relative to the upper first portion thereby changing a length of the upper leg portion.

15. The chair of claim 13, wherein the arm support is slidably coupled to the seat back and is configured to slide along the seat back.

16. The chair of claim 13, wherein the seat bottom is height adjustable along a first axis perpendicular to the ground surface and the seat bottom is rotatable about the first axis.

17. The chair of claim 13, further comprising a stop extending from the seat back and configured to prevent the seat bottom from descending below a predetermined height.

18. The chair of claim 13, wherein the third arm portion is rotatable between an angle of about 0 to about 180 degrees with respect to the second arm portion.

19. The device of claim 13, further comprising a V-shaped headrest telescopically coupled at an end of the chair back opposing the seat bottom, the V-shaped headrest configured to receive the head of a patient.

* * * * *